US006684893B2

(12) United States Patent
Kuo

(10) Patent No.: US 6,684,893 B2
(45) Date of Patent: Feb. 3, 2004

(54) SIMPLIFIED CONTROLLING APPARATUS OF AN AUTOMATIC UMBRELLA

(76) Inventor: Shih-Shin Kuo, 8F, No. 39, Sau Nien Street, Hsinchu (TW)

( * ) Notice: Subject to any disclaimer, the term of this patent is extended or adjusted under 35 U.S.C. 154(b) by 24 days.

(21) Appl. No.: 09/965,817

(22) Filed: Oct. 1, 2001

(65) Prior Publication Data

US 2003/0062074 A1 Apr. 3, 2003

(51) Int. Cl.[7] ..... A45B 25/16
(52) U.S. Cl. ..... 135/24; 135/28; 135/25.1
(58) Field of Search ..... 135/22, 24, 38, 135/28, 25.1, 41

(56) References Cited

U.S. PATENT DOCUMENTS 5,361,792 A * 11/1994 Lin et al. ..... 135/24
5,441,065 A * 8/1995 Lin et al. ..... 135/20.3
5,505,222 A * 4/1996 Lin et al. ..... 135/24
5,566,698 A * 10/1996 Yu ..... 135/24
5,617,889 A * 4/1997 Wu ..... 135/22
5,626,160 A * 5/1997 Ko ..... 135/22
5,626,161 A * 5/1997 Lin et al. ..... 135/24
5,645,094 A * 7/1997 Wu ..... 135/24
5,868,151 A * 2/1999 Kuo ..... 135/22
6,170,498 B1 * 1/2001 Wu ..... 135/22
6,257,257 B1 * 7/2001 Shih ..... 135/24

FOREIGN PATENT DOCUMENTS

EP 425071 * 2/1991 ..... 135/24

* cited by examiner

*Primary Examiner*—Winnie Yip
(74) *Attorney, Agent, or Firm*—Rosenberg, Klein & Lee

(57) ABSTRACT

The present invention relates to a simplified controlling apparatus of an automatic umbrella, which includes a control loop and an elastic control bar. A handle with a single button is provided to receive the controlling apparatus. The simplified structure of this controlling apparatus can effectively control an automatic opening and closing of the umbrella that obtains a utility improvement.

1 Claim, 4 Drawing Sheets

SIMPLIFIED CONTROLLING APPARATUS OF AN AUTOMATIC UMBRELLA

BACKGROUND OF THE INVENTION

A conventional automatic umbrella is able to be opened and closed by using a controlling apparatus provided in a handle of the umbrella. The controlling apparatus usually has two independent buttons to open or close the umbrella respectively. There is another design of the controlling apparatus, which has only a button to open and close the umbrella. But the known later structure always with a large volume is very complex and is possibly broken, such as U.S. Pat. Nos. 5,505,222 or 5,626,161.

Accordingly, the primary object of the invention is to provide a simplified controlling apparatus of an automatic umbrella, which has a single button accompanying with a control loop and an elastic control bar to obtain an improved effect. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
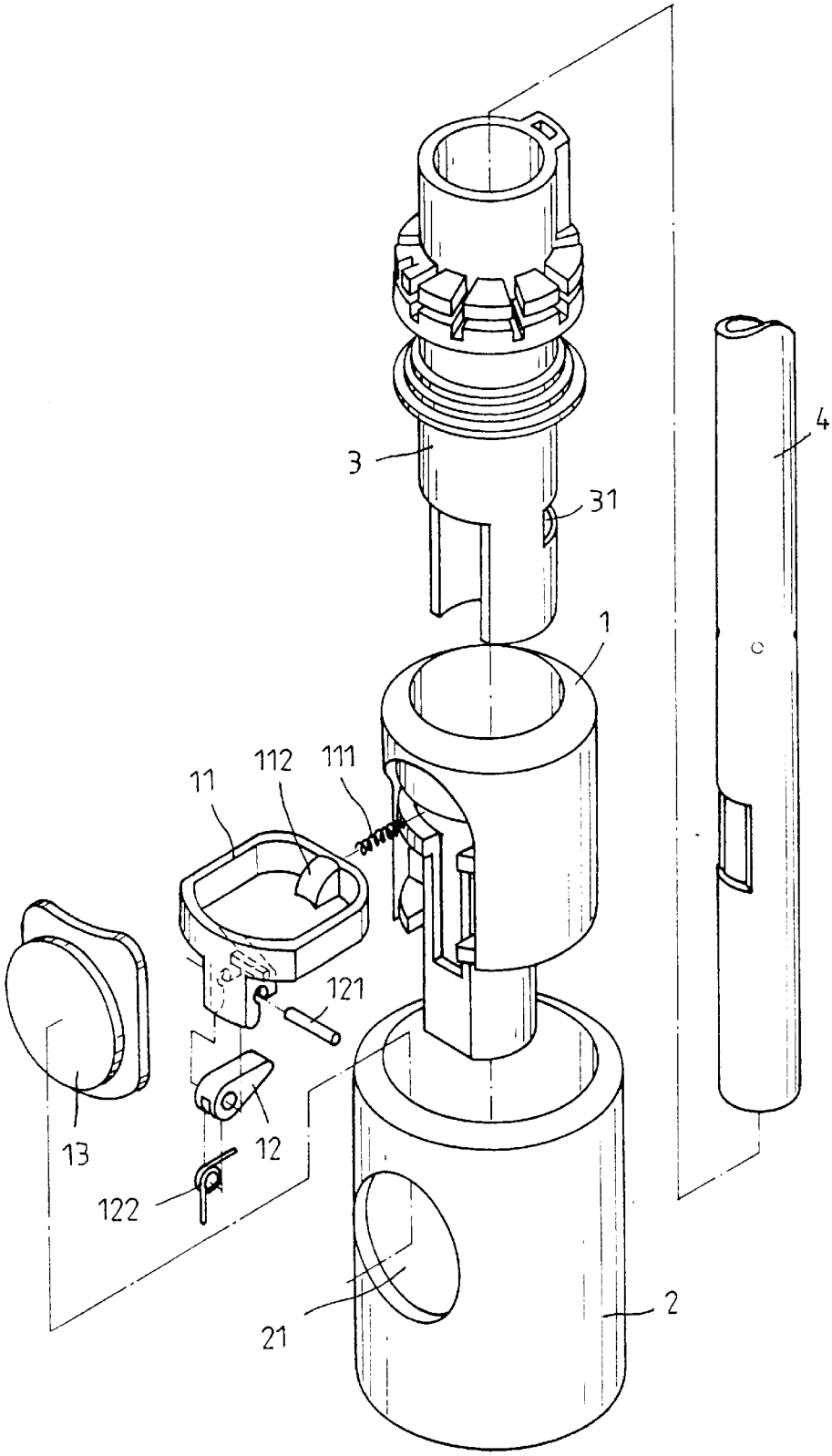
FIG. 1 is an exploded perspective view showing a simplified controlling apparatus of an automatic umbrella according to the present invention.

Please refer to FIG. 1, the present invention relates to improve a controlling apparatus in a handle of an automatic umbrella. The controlling apparatus includes a hollow main body (1) to receive therein with a control loop (11) and is positioned in the handle (2) while a shaft (4) of the umbrella passing through its central part. A button (13) is provided by a side of the body (1) and is exposed from an opening (21) of the handle (2).

The control loop (11) has provided with a small spring (111) at a side to provide an elastic force for the loop (11) toward the button (13). A tongue (112) is formed at an inner position relating to spring (111) to engage with an aperture (31) of a runner (3) when the umbrella is pressed and is ready for use. A control bar (12) is pivoted by a rod (121) on the control loop (11) at a bottom position near the button (13) and is provided with a spring (122) on the rod (121) to keep the bar (12) being elastically maintained parallel.

Figure 2:
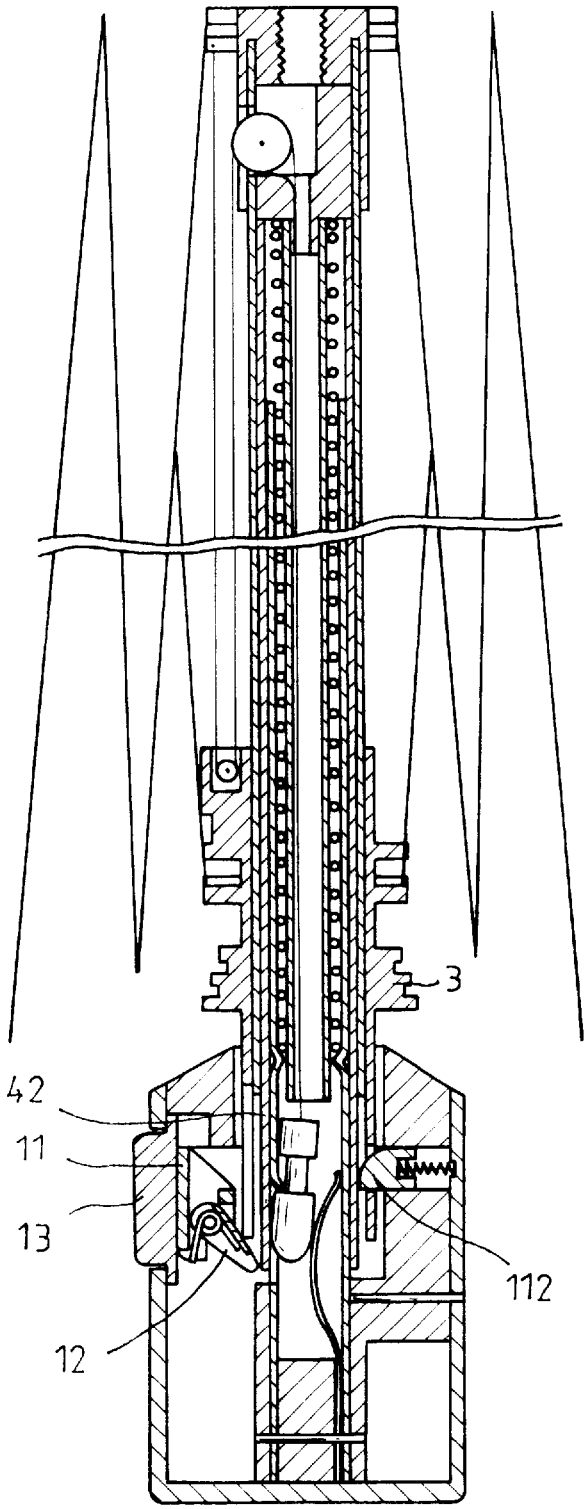
FIG. 2 is a cross-sectional plan view showing the umbrella of FIG. 1 in assembly after being pressed according to the present invention.
Figure 3:
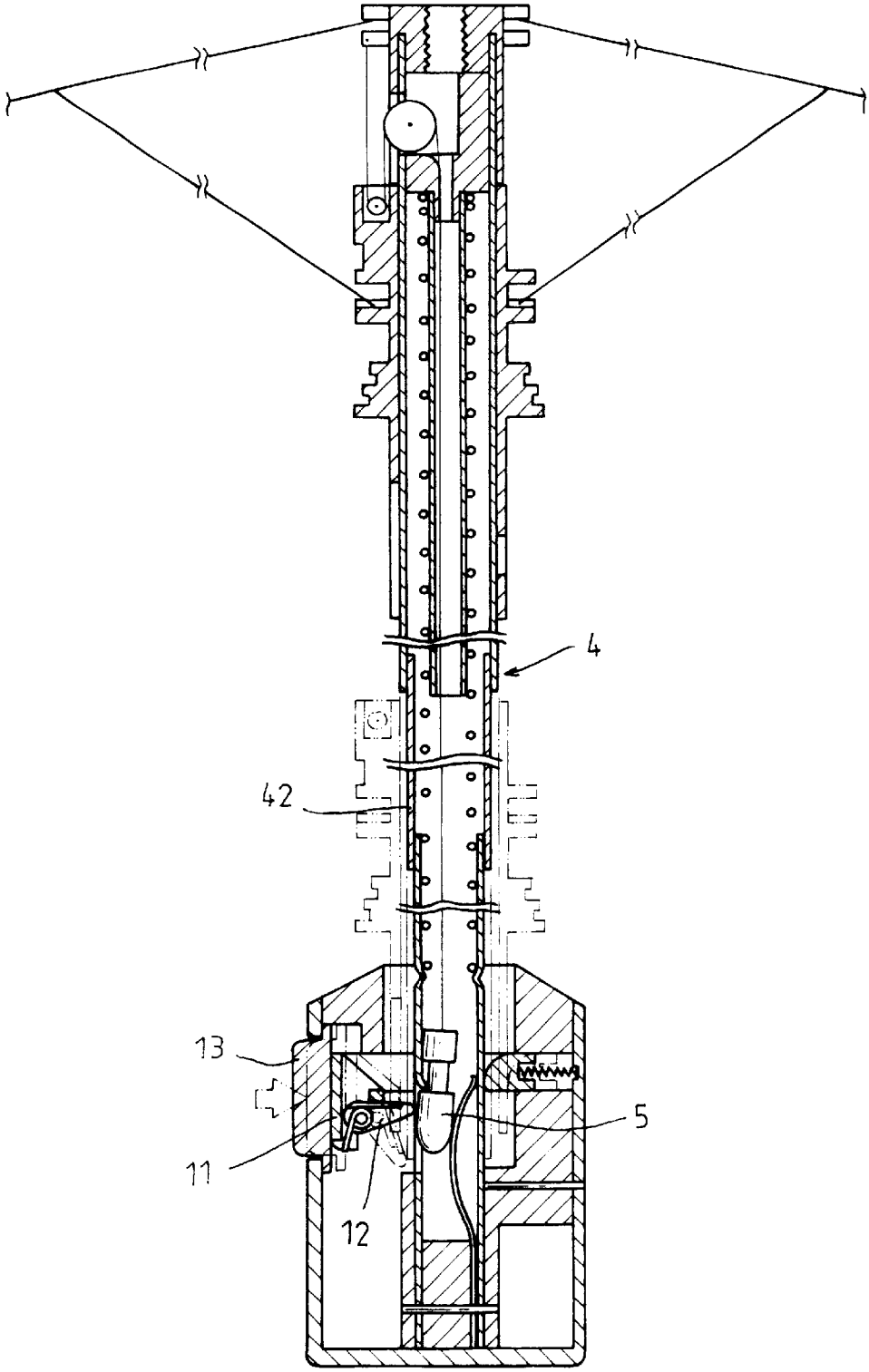
FIG. 3 is a cross-sectional plan view of FIG. 2 after pressing a button first time to open the umbrella.
Figure 4:
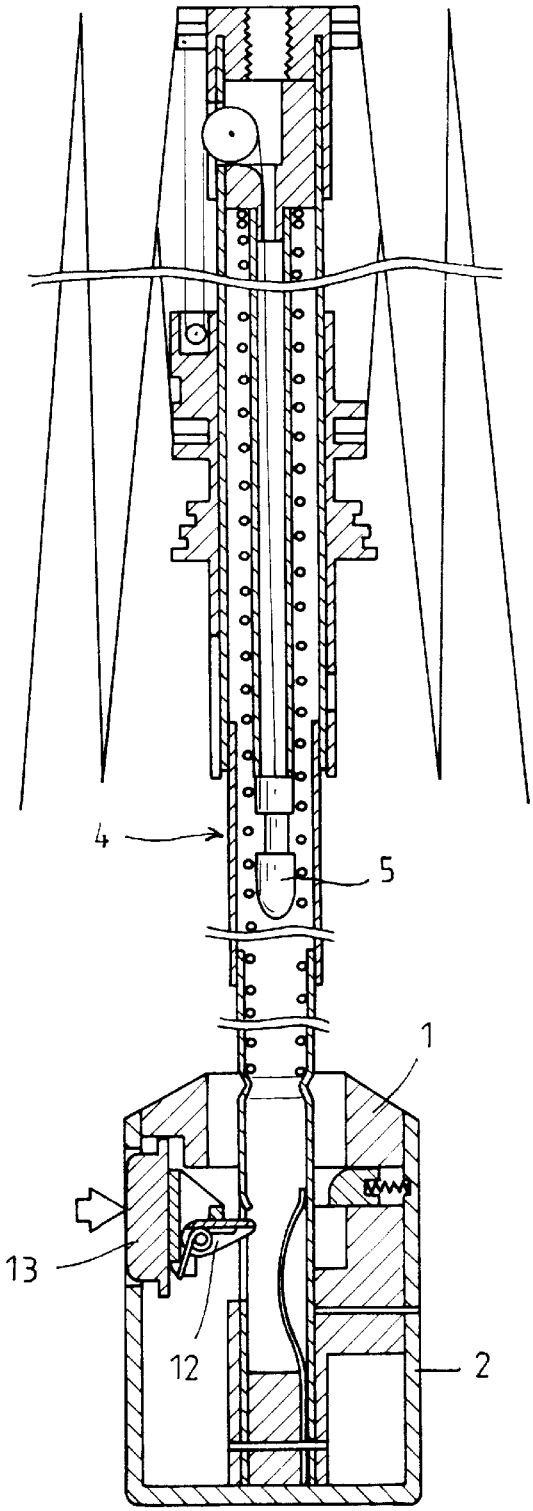
FIG. 4 is a cross-sectional plan view of FIG. 3 after pressing the button second time to close the umbrella.

When the umbrella is pressed for use, as shown in FIG. 2, the runner (3) is engaged by the tongue (112) of the control loop (11) and the control bar (12) is inclined downward by a second tube (42) of the shaft (4). Referring to FIG. 3, when pressing the button (13) first time, the control loop (11) is moved inward and the tongue (112) is departed from the runner (3). The umbrella will be automatically opened under a known elastic force of springs in the shaft or on the frame of the umbrella. At this moment, since the second tube (42) is moved upward, the control bar becomes parallel.

When to close the umbrella, one can press the button (13) second time, the control bar (12) can push a bullet-head (5) inward to depart from engagement with the shaft (4) and to lift upward for automatic closing.

Accordingly, the present invention provides an invented structure with improved utility. It obviously gains the utility and novelty for patent and is thus applied.

What is claimed is:

1. A controlling apparatus for an automatic umbrella comprising:

(a) a handle having a control button;

(b) a hollow main body received in said handle, said hollow main body having a compartment extending axially therein;

(c) a shaft coupled to said hollow main body, said shaft passing through said compartment, said shaft having a bullet head member disposed displaceably therein;

(d) a runner coaxially disposed about said shaft for reversible axial displacement relative thereto between opened and closed positions, said runner having an upper portion and lower portion extending therefrom, said lower portion in one of said opened and closed positions extending axially into said hollow main body compartment;

(e) a control loop member disposed in transversely displaceable manner responsive to said control button within said hollow main body compartment for displacement between first and second positions relative to said hollow main body, said control loop member including a transversely protruding tongue portion for, in said first position, retentively engaging said lower portion of said runner when said runner is disposed in said one of said opened and closed positions;

(f) a spring coupled to said control loop member and said hollow main body for resiliently biasing said control loop member to said first position; and, (g) a control bar member pivotally coupled to said control loop member for displacement between retracted and extended positions, said control bar member being resiliently biased to one of said retracted and extended positions, whereby said control bar member is selectively disposed to extend into said hollow main body compartment for directly engaging said bullet head member responsive to displacement of said control loop member.

* * * * *